United States Patent [19]

Usner

[11] Patent Number: 4,557,516

[45] Date of Patent: Dec. 10, 1985

[54] MULTIPLE GARMENT HANGER TRANSFER DEVICE

[76] Inventor: Daniel C. Usner, 10958 Tanager Trail, Brecksville, Ohio 44141

[21] Appl. No.: 610,977

[22] Filed: May 16, 1984

[51] Int. Cl.[4] ..... A47J 51/084; A47J 51/24

[52] U.S. Cl. ..... 294/143; 223/88

[58] Field of Search ..... 294/143, 145, 146, 161, 294/162, 165; 223/85, 88; 211/113, 123, 118, 124; 248/215, 304, 339

[56] References Cited

U.S. PATENT DOCUMENTS 3,317,055 5/1967 Roscicki ..... 294/143

4,296,959 10/1981 Helbig ..... 294/143

4,474,316 10/1984 Philibert ..... 223/88

*Primary Examiner*—James B. Marbert

*Attorney, Agent, or Firm*—Milton L. Simmons

[57] ABSTRACT

There is provided a multiple garment hanger transfer and clamping device, adaptable for suspending a number of hanger-hung garments for vertical rope-sling loading, which transfer device is adaptable for skimming, in one continuous motion, a multiplicity of garment hangers from either a garment trolley bar or a garment storage bar, and clamping them firmly together for transfer to said rope sling.

5 Claims, 4 Drawing Figures

MULTIPLE GARMENT HANGER TRANSFER DEVICE

Figure 1:
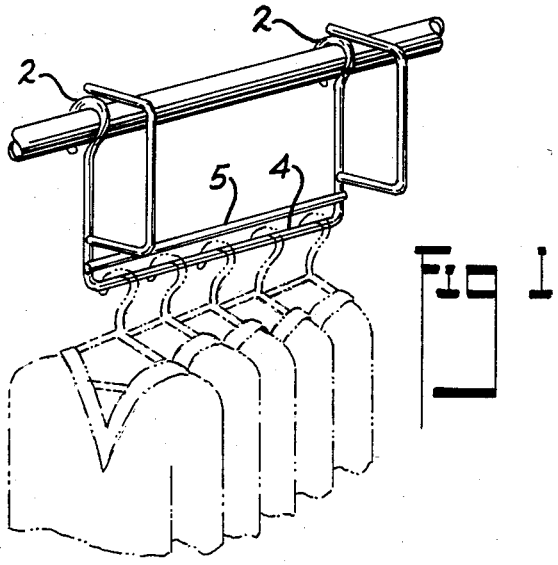

In the garment trade, in transporting hanger-hung garments from wholesale to retail facilities, from consolidator to warehouse, from warehouse to sales floor, or simply from one storage point to another, it is the practice to expedite such transfer by hanging the garments on a trolley bar at an initial point, then transferring the garments from the trolley bar to either storage bars or to hanging facilities in a truck for transporting said garments to a wholesale, retail or holding facility.

One of the major problems encountered in removing individual garment hangers from a garment trolley bar at a trolley terminus, situated on a loading or shipping dock, is that a great deal of hand labor and time is expended in transferring individual hanger-hung garments from a trolley bar, to either rope-slings, or to shipping bars horizontally fixed within the body of a shipping vehicle.

Furthermore, unless each individual garment is covered with a protective wrapper, the tendency is for a workman to grasp two, possibly three or more garments, plus their respective individual hangers, in each hand, by the shoulders thereof, to facilitate removal of the garments and their respective hangers from the trolley bar for subsequent re-hanging on the truck shipping bar or rope sling.

This obviously promotes a high degree of soilage of the garments, with the obvious, attendant, unfavorable consequences resulting from a workman's hands tearing through any thin protective wrapper thereby encountering the garment directly; another source of soilage and wasted time arises if the workman attempts to grasp too many garments, and one or more garments centrally located in his grasp slip and fall from between the adjacent garments between which they are sandwiched. Garments falling to the floor of the dock or transport vehicle, are not only likely soiled simply from encountering the floor, but if the workman is moving quickly, the chances are great that he'll tread on one or more garments, thereby aggravating the situation.

Figure 4:
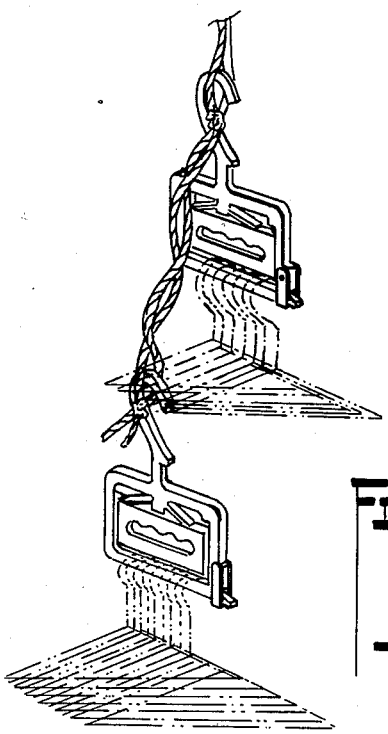
Figure 2:
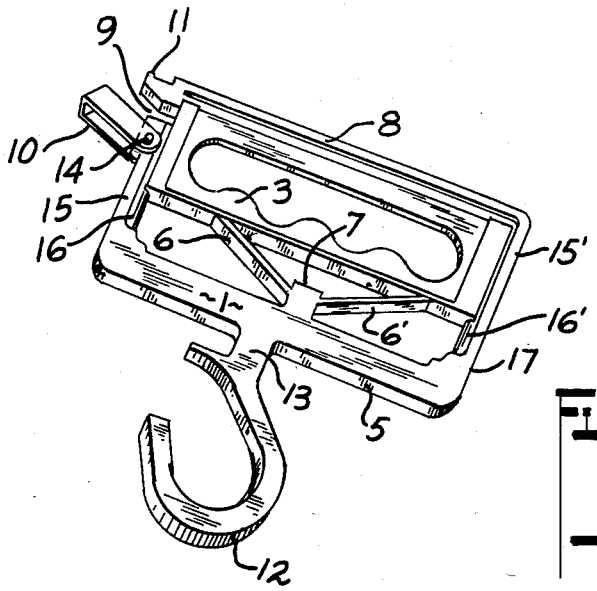
Figure 3:
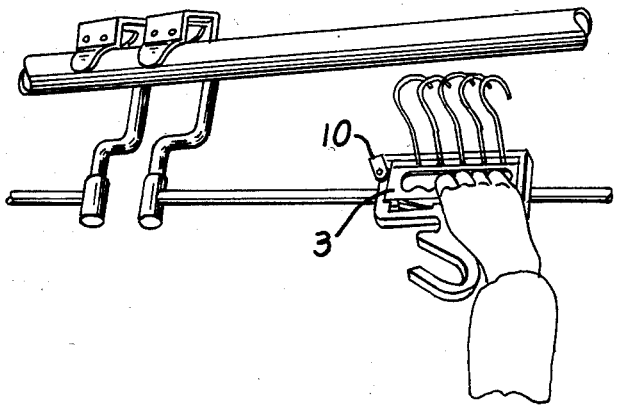

Referring now to the drawings attached hereto, and made a part hereof:

FIG. 1. is a perspective view of a prior art device over which the instant device is believed to be a decided improvement; and, FIG. 2. is a perspective view of the device of the instant invention; and, FIG. 3. illustrates the device of the instant invention in the skimming mode; and, FIG. 4. is a perspective view of how a series of the devices of this invention would appear suspended from a vertical rope sling.

One proposed solution to the problem has been to devise a multiple hanger as depicted in FIG. 1, with a hook 2, and a vertical loop handle attached to each hook, said device having a hanger bar 4, and hanger restraining bar 5, the entire device adapted to be suspended from a trolley bar. A number of hanger-hung garments may then be placed on the hanger bar, and at the shipping dock, via each vertical handle aforesaid, a shipping operator, using two hands, can grasp said support, with all its hanger-hung garments, and immediately transfer same to a truck-mounted bar.

However, the double-hooked device of FIG. 1, has a number of drawbacks. First, of necessity, it must have a considerable span between the garment hanger support, and the crook of each hook thereof, because such span is dictated by the vertical hand grip associated with each hook.

So, by its construction, such device could not possibly be used to "skim" a number of hangers which had been initially hung on a trolley bar, because the conventional distance between a trolley bar and its trolley is too short to permit skimming by the FIG. 1 apparatus, all as elaborated upon hereinafter.

Furthermore, as depicted in FIG. 4 hereof, it has been found that shipping space can be much more efficiently utilized, if, instead of horizontal shipping bars disposed within the body of the shipping van, a number of vertical rope "gang" slings are suspended from the roof of the shipping vehicle, the slings being nothing more than looped, double rope, with a series of knots therein at approximately 25 cm., intervals.

Traditionally, single hangers of garments were hooked above the successive knots, permitting anywhere from 5 to 10 hanger-hung garment to be hooked into the gang sling in the loop above a given knot. Ideally, the prior, twin-hooked device, if it could be so utilized, would be lifted, with its multiplicity of hanger-hung garments, directly from a trolley bar, then hooked to the vertical rope sling. But obviously, this is impossible in that only one hook could be engaged, which would cause all of the garments to jam together, off balance, under the other hook at the other end. Finally, a person cannot conveniently lift two of FIG. 1 devices simultaneously from a trolley bar, since it would obviously be a two-handed operation to hang or remove one of the FIG. 1 devices.

But the transfer, clamping device of the instant invention, as will be hereinafter developed in more detail, can be used singlehandedly to skim and remove a multiplicity of hanger-hung garments by engaging the hanger shanks, and lifting same from the trolley bar in one continuous motion, for rapid transfer to a rope sling. At some point in the operation, the lockinglatch of the instant device may be closed, and a novel spring-actuated keeper, or clamping device, firmly engages the hanger shanks to prevent disengagement through vibration in transport.

Other prior systems have also attempted to expedite transfer by a skimming device which the operator pushed forward, away from himself, over the top of the trolley bar, engaging a multiplicity of hanger hooks on the opposite side, then lifting same from the trolley bar and pulling toward the operator. However, this system also had a number of drawbacks in that the space is very limited between the trolley bar and the trolley thereby wreaking havoc with the operator's hands, resulting in a number of garments falling to the floor, etc.

But the device of the instant invention eliminates all of the foregoing problems by permitting an operator to skim numerous hanger shanks from the trolley bar, (without the need for his reaching over the top of the trolley bar) lifting and removing in one motion a multiplicity of hangers, then, transferring the load of garments directly to a rope sling where they are supported by the slightly offset hook of the instant device.

It is therefore, an object of this invention to provide a relatively simple, lightweight, strong yet efficient and effective, multiple garment hanger support, clamping and transfer device, having a single hook and adaptable to skim a multiplicity of garment-hung hangers from a trolley bar by engaging the hanger shanks in one continuous motion, and further adaptable to be quickly and easily hung, along with its suspended, hanger-hung garments, from a vertical rope sling.

It is a further object of this invention to provide a multiple garment hanger support and transfer device, having a keeper or clamping member which engages garment hung hanger-hook shanks whereby they are prevented from becoming disengaged through vibration in handling or shipping, thereby preventing garments falling to the floor.

Referring now to the drawings by way of describing the structure and function of this invention, reference numeral 1 of FIG. 2 depicts generally the hand-actuated clamping device constituting the multiple garment transfer device of this invention.

As will be noted, the outer configuration of the device is generally rectangular and the main frame thereof, designated generally by the reference numeral 17, also has a generally rectangular, corresponding opening, which accommodates a slidably mounted finger-engaging and clamping member 3; said slidable clamping member 3 retained within main frame 17 by a pair of guide rails 16 and 16'.

In operation, and as depicted in FIG. 3, the palm of the hand may readily grasp the device as shown, the palm engaging a leg of the main frame designated as the palm-engaging member 5, the fingers grasping slidable clamping member 3, and by exerting a squeezing motion, member 3 is pulled toward palm-engaging member 5 against the resistance of the two leaf springs 6 and 6', with the movement of member 3 arrested by stop 7. Upon relaxing the hand, slidable clamping member 3 is urged back into snug, clamping contact with leg member 8, which is directly opposite to palm-engaging member 5.

There is an opening generally designated by the reference numeral 9 in one leg of the device, two of which legs, 15 and 15' maintain said palm-engaging member and the leg opposite thereto in spaced juxtaposition. A locking latch 10 is provided as indicated, which may be readily flipped to either the open or closed position, being latched in the closed position frictionally by engaging a lug or ridges 11 on leg 8.

Offset slightly toward the "thumb" end of the device, is a hook 12 and hook shank 13, adaptable to engage and hang from a trolley bar. For purposes of this invention, the opening 9, locking latch 10 and locking lug 11, may be placed, obviously, on either side of the clamping device.

Referring now to FIG. 3, in operation, with locking latch open, an operator may quickly squeeze the clamping device into its "open" position with one motion, engage the shanks of a series of garment-hung, garment hangers hung from a trolley bar, close locking latch 10, and (since the closed hanger loops will always be toward the operator), in one motion, lift a multiplicity of garment-hung hangers from the trolley bar, and with another motion, hang the entire assembly on a truck-mounted gang, rope-sling for transport. At the destination, the procedure is simply reversed, i.e., the device with its garments is lifted off the gang-sling, the hangers, in one motion, are quickly transferred to a conveyor trolley bar, the clamping device opened and disengaged.

Aside from the novel, inventive concepts of the device shown from the standpoint of its structural and operable uniqueness, it is believed that invention also resides in the fact that it is composed of only three, basic, unitary and functional components.

That is, the device shown, and indeed the preferred composition for the entire device, is composed of thermoplastic polypropylene. The main frame 17 and slidable clamping member 3, may be extruded and molded, then while one or the other (or both) are still relatively hot and pliable, the slidable member 3 may be readily deformed slightly and placed into position within main-frame 17. Upon cooling, both members assume the perfectly straight configuration of the dies within which they were molded, while assuming the structural rigidity necessary to function as intended.

Note that stop 7 and leaf members 6 and 6', are molded integrally with main frame 17, which generally uses the room temperature stiffness and rigidity to perform its function, but at the same time, the same material, when formed into leaf springs 6 and 6', surprisingly functions firmly, resiliently and repeatedly throughout countless test squeezings, to urge sliding member 3 snugly into clamping contact with leg 8.

The "squeezing" tension of the device depicted requires roughly three pounds of force to move member 3 away from leg 8, but by varying the thickness of leaf spring members 6 and 6', throughout their entire length, or close to their respective roots, such tension may be adjusted upwardly to whatever might be required for a given purpose.

It is to be noted that hook 12 and its shank 13 are also molded integrally with main frame 17 for performing a function, and resisting stresses, totally different and unrelated to those to which either leaf springs, or main frame 17 are generally subjected to.

While the preferred thermoplastic resin is polypropylene, it is believed that the resins polyacetal and nylon would perform equally well.

The third operational, functional member is locking latch 10, which may be extruded or otherwise formed independently, preferably of the same material as the main frame and slidable clamping member 3.

Although a hinge pin 14 is obviously reqired for retention and rotation of locking latch 10, such pin is not considered an essential, functional component since main frame 17 could be just as easily molded with a pair of opposed circular lugs adjacent opening 9, whereby each prong of locking latch 10, while still at an elevated temperature, and with a pair of suitable, corresponding, circular openings therein, are spread, and slid over said lugs, about which the latch could then rotate. Such lugs would correspond to pin 14, and the device would still be composed solely of three, unitary functional components.

While there is depicted a swingable locking latch 10, an equivalent sliding latch could be readily provided which could be slidably mounted on the "open" leg, and pushed into locking contact with leg 8 after a number of hanger shanks have been engaged by the device.

While the preferred device of this invention is actuated by a pair of leaf springs 6 and 6'', a looped, leaf buggy-type spring could be utilized; a single, off-set, leaf could be utilized, or a "V" spring could be provided with one leg of said V fixed to palm-engaging member 5, with the other leg riding free and urging clamping member 3 toward leg 8.

Obviously, it is contemplated that any of the variety of springs just described would be unitary and molded integrally with main frame 17.

Naturally, any variety of metallic, coil spring devices, could be utilized within the scope of this invention, but the concept of a unitary spring fashioned of the same material as the main frame, and integral therewith, in a one-step process, is simply considered an added, inventive concept.

Finally, although hook 12 and shank 13, depicted in FIG. 4, lie in the same plane as main frame 17, it is contemplated that they could be molded at a 90°, or any other, angle with said plane.

Wherefore, having fully and completely described the device hereof and its application, the inventive concepts embodied above are set forth in the following claims.

I claim:

1. A hand-actuated clamping device comprising a main-frame component having a generally rectangular opening therewithin, one leg of said main frame comprising a palm-engaging member, a combination finger-engaging and clamping member slidably mounted within said rectangular opening of said main frame, and disposed to engage and contact in clamping relationship a leg of said main frame opposite said palm-engaging member, spring means constantly urging said finger-engaging member into snug, clamping contact with the opposite leg aforesaid, an opening in one or the other legs of said main frame which maintain said palm-engaging member and the leg opposite thereto in spaced juxtaposition, said opening adjacent said opposite leg, a locking latch for closing said opening, said palm-engaging member also having hook means affixed thereto, said hand-actuated clamping device adapted to be grasped by one hand and further adapted, by squeezing said palm-engaging and finger-engaging members toward each other, to thereby disengage said spring-urged, finger-engaging and clamping member, away from said opposite leg, and by relaxing said hand, said finger-engaging and clamping member are urged back in to firm, clamping contact with said opposite leg by said spring means.

2. The clamping device of claim 1 wherein the entire device is composed primarily of three, unitary, functional components.

3. The device of claim 1 wherein the spring means is formed integrally with the main frame.

4. The device of claim 3 wherein said spring means is an open, double-leaf spring.

5. The device of claim 4, wherein the three, functional components, are all formed from the same thermoplastic resin, selected from the group consisting of polypropylene, polyacetal and nylon.

* * * * *